US007152278B2

(12) United States Patent
Bernhardt et al.

(10) Patent No.: US 7,152,278 B2
(45) Date of Patent: Dec. 26, 2006

(54) NONWOVEN CARD FOR THE PRODUCTION OF NONWOVEN FABRIC OF FIBER MATERIAL

(75) Inventors: Siegfried Bernhardt, Bremen (DE); Robert Kamprath, Brake (DE); Heinz-Werner Naumann-Burghardt, Berne (DE)

(73) Assignee: Spinnbau GmbH, Bremen (DE)

( * ) Notice: Subject to any disclaimer, the term of this patent is extended or adjusted under 35 U.S.C. 154(b) by 289 days.

(21) Appl. No.: 10/808,400

(22) Filed: Mar. 25, 2004

(65) Prior Publication Data

US 2004/0187267 A1 Sep. 30, 2004

(30) Foreign Application Priority Data

Mar. 28, 2003 (DE) ..... 103 14 009

(51) Int. Cl.
*D01G 15/00* (2006.01)

(52) U.S. Cl. ..... 19/98

(58) Field of Classification Search ..... 19/98–101, 19/105, 106 R, 112, 102, 104, 110, 111, 113, 19/296, 302, 303
See application file for complete search history.

(56) References Cited

U.S. PATENT DOCUMENTS 2,835,929 A * 5/1958 Taine et al. ..... 19/99
4,523,350 A * 6/1985 Schmiedgen et al. ..... 19/98
4,723,343 A * 2/1988 Bernhardt et al. ..... 19/98
4,843,685 A * 7/1989 Vesa et al. ..... 19/98
4,852,217 A * 8/1989 Bernhardt et al. ..... 19/98
5,226,214 A * 7/1993 Napolitano ..... 19/296
6,073,313 A * 6/2000 Lasenga et al. ..... 19/99
6,553,630 B1 * 4/2003 Rubenach ..... 19/105

FOREIGN PATENT DOCUMENTS

EP 0 188 177 B1 8/1988

* cited by examiner

*Primary Examiner*—Gary L. Welch
(74) *Attorney, Agent, or Firm*—Diller, Ramik & Wight

(57) ABSTRACT

In a nonwoven card for the production of nonwoven fabric of fiber material, with a drawing-in means (2,4), a licker-in (6), a main cylinder (16), and at least one fiber doffer means (18) engaged with the main cylinder (16), for doffing a card web, the drawing-in means (2,4) transferring the fiber material to the licker-in (6) and a transfer means (8) transferring the fiber material at least double from the licker-in (6) to the main cylinder (16) via rollers (10, 10*a*, 10*b*, 10*c*, 12, 12*a*, 12*b*, 14), it is provided that at least one of the rollers (10, 10*a*, 10*b*, 10*c*, 12, 12*a*, 12*b*, 14) of the transfer means (8) is a random roller (10, 10*a*, 10*b*, 10*c*) rotating in the same direction as the main cylinder (16) and the licker-in (6).

12 Claims, 12 Drawing Sheets

NONWOVEN CARD FOR THE PRODUCTION OF NONWOVEN FABRIC OF FIBER MATERIAL

BACKGROUND OF THE INVENTION

1. Field of the Invention

The invention relates to a nonwoven card.

2. Description of Related Art

Such a nonwoven card is known from European Patent EP 0 188 177. The nonwoven card comprises a drawing-in means transferring fiber material to a licker-in as well as a transfer means transferring the fiber material from the licker-in to a main cylinder of the nonwoven card via rollers at least double. In the known state of the art, transfer rollers are used on two transfer paths only.

SUMMARY OF THE INVENTION

It is the object of the present invention to provide a nonwoven card and a method for the production of nonwoven fabric of fiber material where the carding efficiency in the region in front of the main roller of a card can be increased and the quality of the fibrous webs produced can be improved thereby.

The invention advantageously provides that in a transfer means between licker-in and main cylinder, which repeatedly transfers the fiber material, at least one of the rollers is a random roller rotating in the same direction as the main cylinder and the licker-in. The random roller permits a return feed at the licker-in so that the carding capacity of the licker-in can be used repeatedly. Furthermore, there is a distinctly higher carding efficiency in the region of the transfer points.

On at least one or on any transfer path, the transfer means may comprise only one roller between the licker-in and the main cylinder.

The only roller may be a random roller.

Alternatively, a random roller may be arranged in combination with a transfer roller on at least one transfer path, the random roller being engaged with the licker-in.

According to another alternative, the transfer means may comprise at least three rollers at least two of which are engaged with the licker-in and the main cylinder.

The at least three rollers may interengage.

The transfer means may comprise at least three rollers each of which is engaged at least with the licker-in and the main cylinder.

The neighboring rollers of the transfer means may also be in mutual engagement.

All the rollers of the transfer means may also be exclusively random rollers.

The at least one random roller may comprise carding elements in the form of a pair of worker/clearer rollers or in the form of carding plates.

BRIEF DESCRIPTION OF THE DRAWINGS

Hereinafter, several embodiments of the invention are explained in detail with reference to the drawings, in which.

DETAILED DESCRIPTION OF THE PREFERRED EMBODIMENTS

Figure 1:
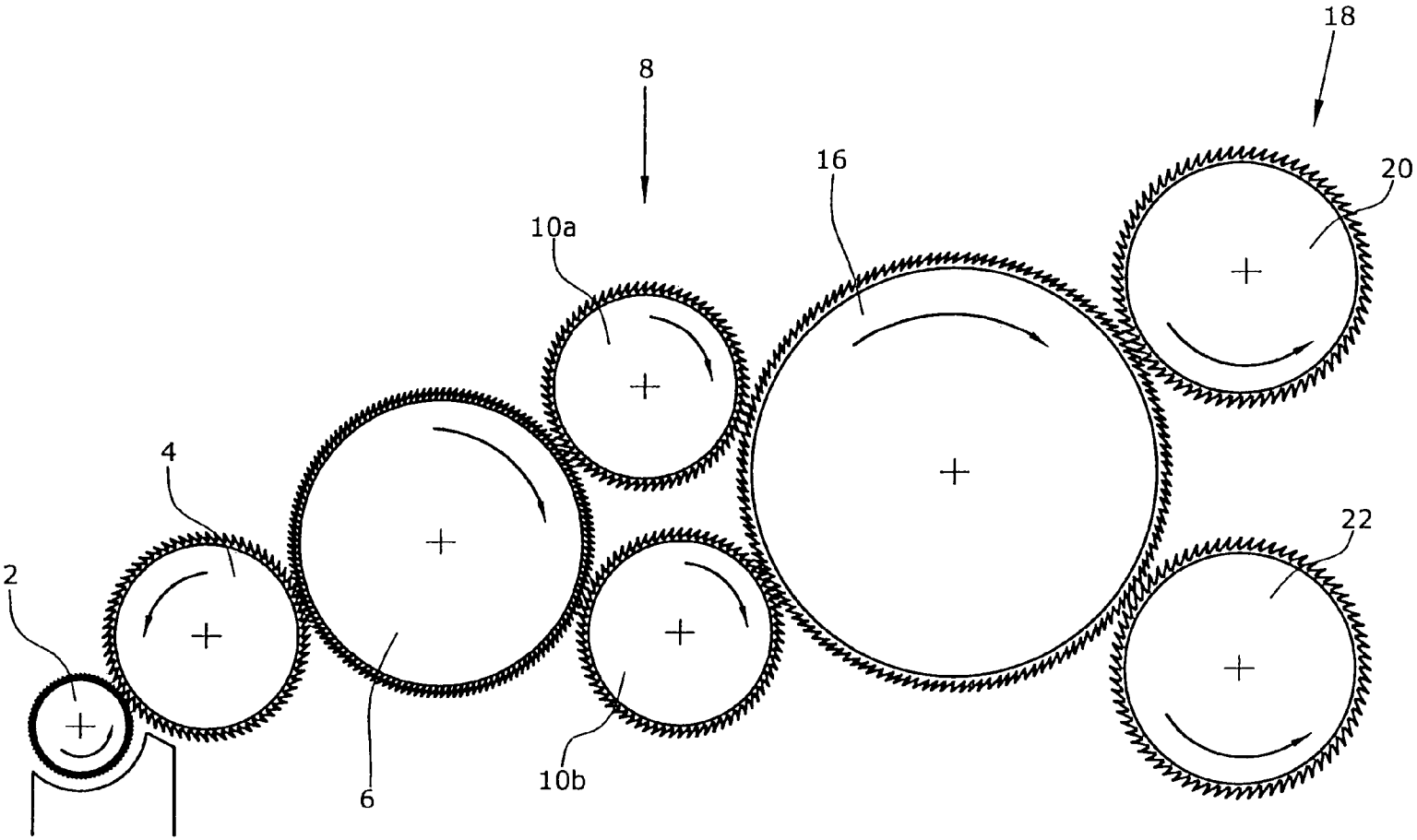
FIG. 1 shows a first embodiment of the invention with two random rollers.

FIG. 1 shows a first embodiment of a nonwoven card with a drawing-in means consisting of a drawing-in roller 2 and a taker-in 4. The fiber material drawn in by the drawing-in roller 2 and the taker-in 4 is transferred to a licker-in 6. By means of a transfer means 8 consisting of several rollers, the fiber material is transferred from the licker-in 6 to a main cylinder 16 from which one or more fibrous webs can be doffed by means of a fiber doffer means 18. In the embodiments, the fiber doffer means 18 is represented by two doffer rollers 20,22 each of which takes over a fibrous web from the main cylinder 16 and then transfers the doubled or non-doubled fibrous webs to transport means via further non-illustrated doffer means.

In the embodiment of FIG. 1, the transfer means 8 consists of two random rollers 10*a*, 10*b* forming a transport path each, a return feed at the licker-in being possible so that the carding capacity of the licker-in is used repeatedly. Furthermore, this results in a distinctly higher carding efficiency in the region of the transfer points between the licker-in 6 and the random roller 10*a* and 10*b*, respectively, as well as at the points of transfer from the random rollers 10*a*, 10*b* to the main cylinder 16.

Figure 2:
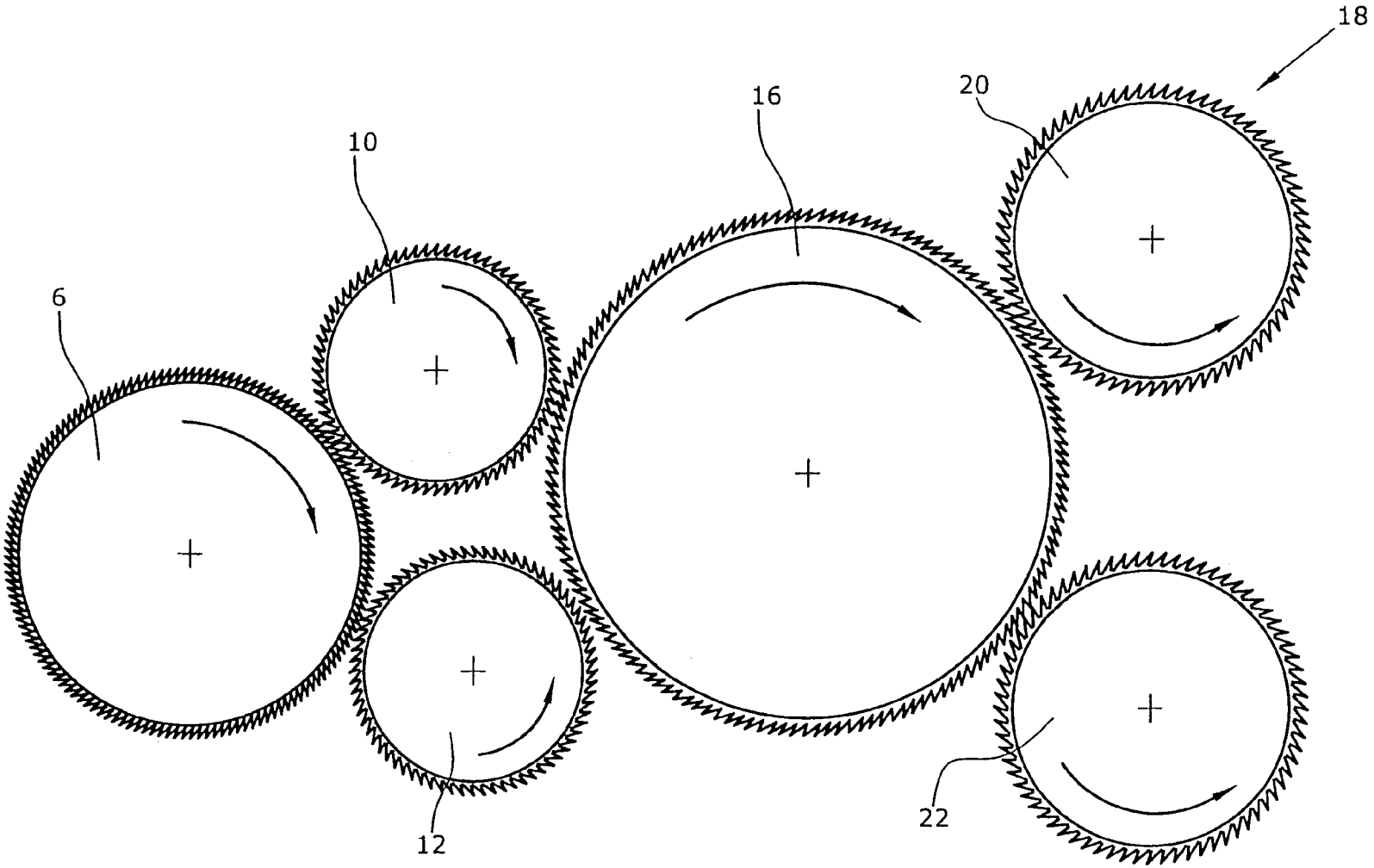
FIG. 2 shows a second embodiment with a random roller and a transfer roller.

FIG. 2 is a modification of the embodiment of FIG. 1 where the lower roller is a transfer roller 12. In contrast to the embodiment of FIG. 1 where a return feed via the random rollers 10*a*, 10*b* is effected, the transfer roller 12 completely empties the licker-in 6.

Figure 3:
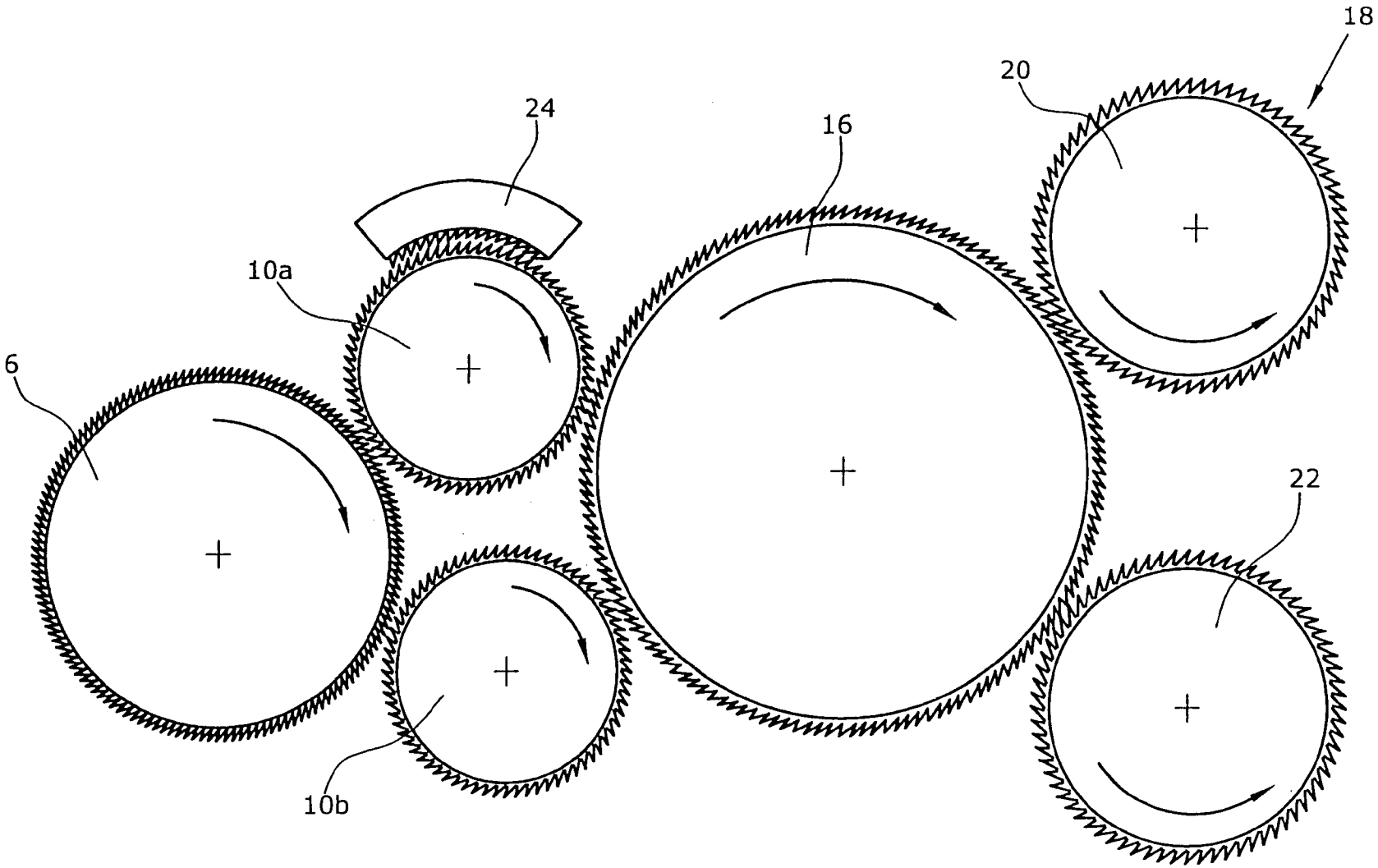
FIG. 3 shows a variant of the embodiment according to FIG. 1.

FIG. 3 shows a variant of the embodiment of FIG. 1 where a carding plate 24 is arranged on the top random roller to further increase the carding efficiency. In the embodiment of FIG. 2, it is of course possible to provide a carding plate 24 at the random roller 10 as well.

Figure 4:
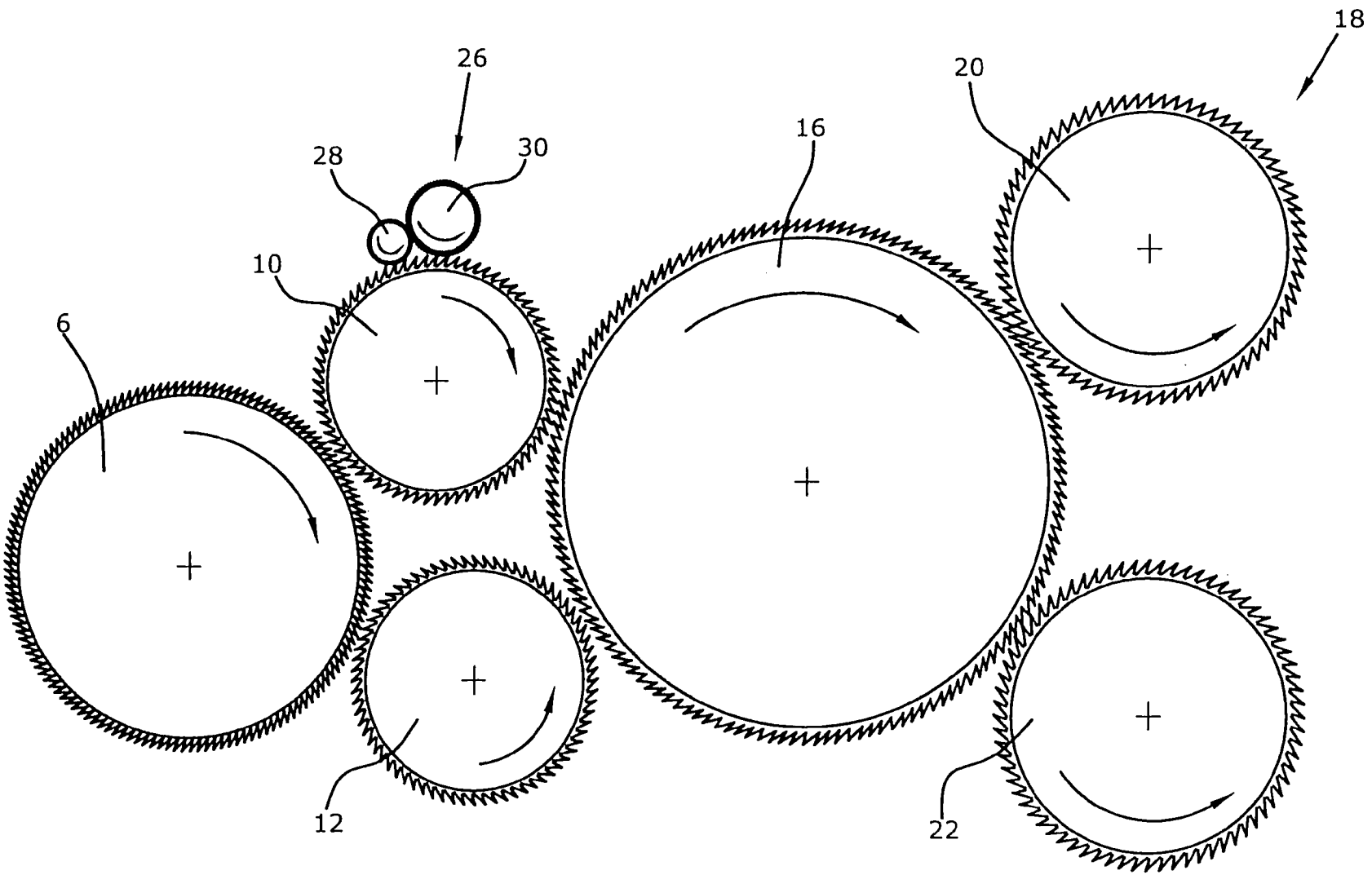
FIG. 4 shows a variant of the embodiment of FIG. 2.

FIG. 4 shows a variant of the embodiment of FIG. 3 where a carding element 26 consisting of at least one pair of worker/clearer rollers 28,30 is provided instead of the carding plate 24.

Figure 5:
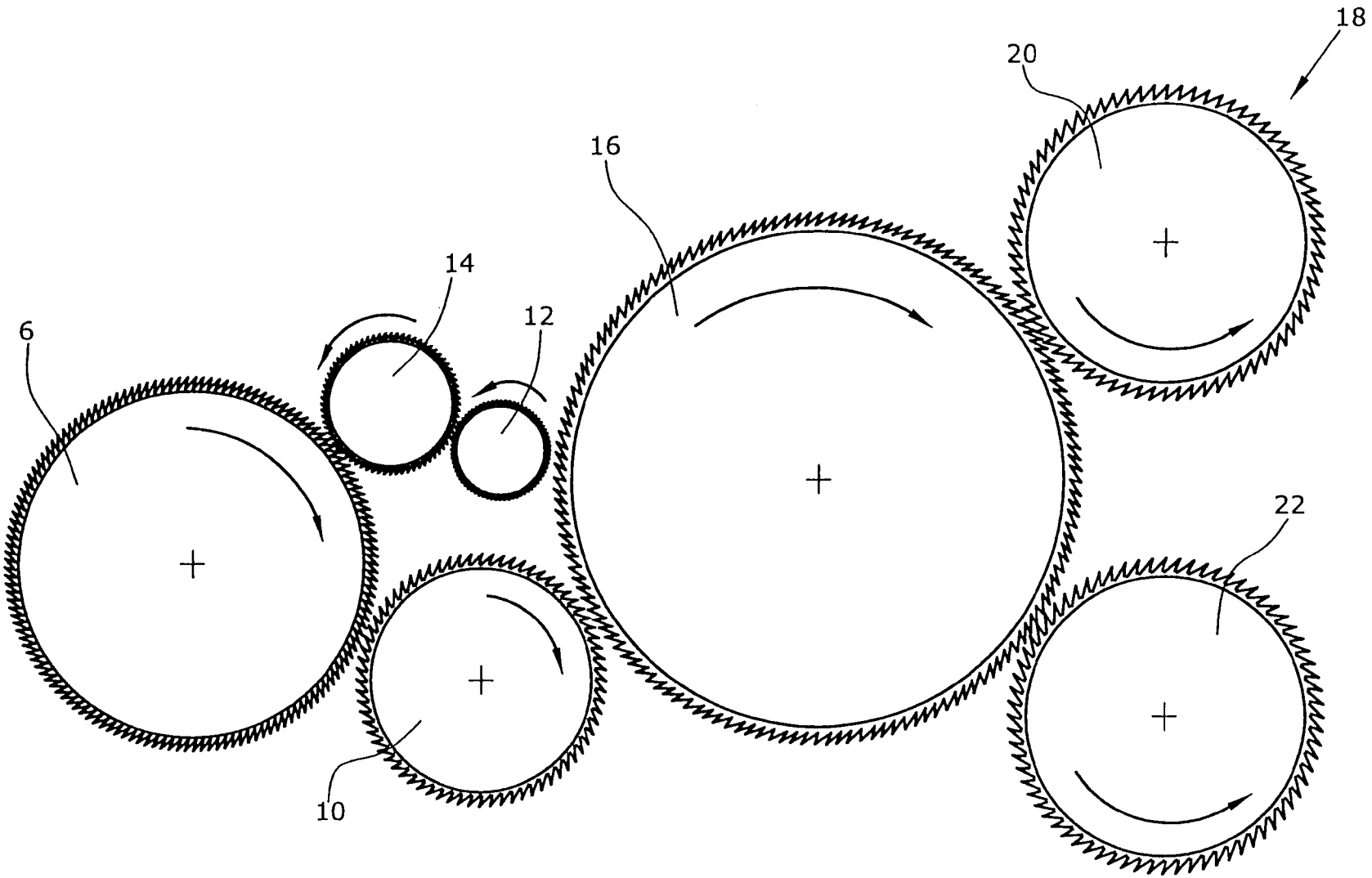
FIG. 5 shows a fifth embodiment with a transfer roller and a random roller.

FIG. 5 shows an embodiment where the lower transfer path is formed by a random roller 10 and the upper transfer path is formed by an intermediate doffer 14 engaged with the licker-in 6 and a transfer roller 12 engaged with the intermediate doffer 14 and the main cylinder 16.

Figure 6:
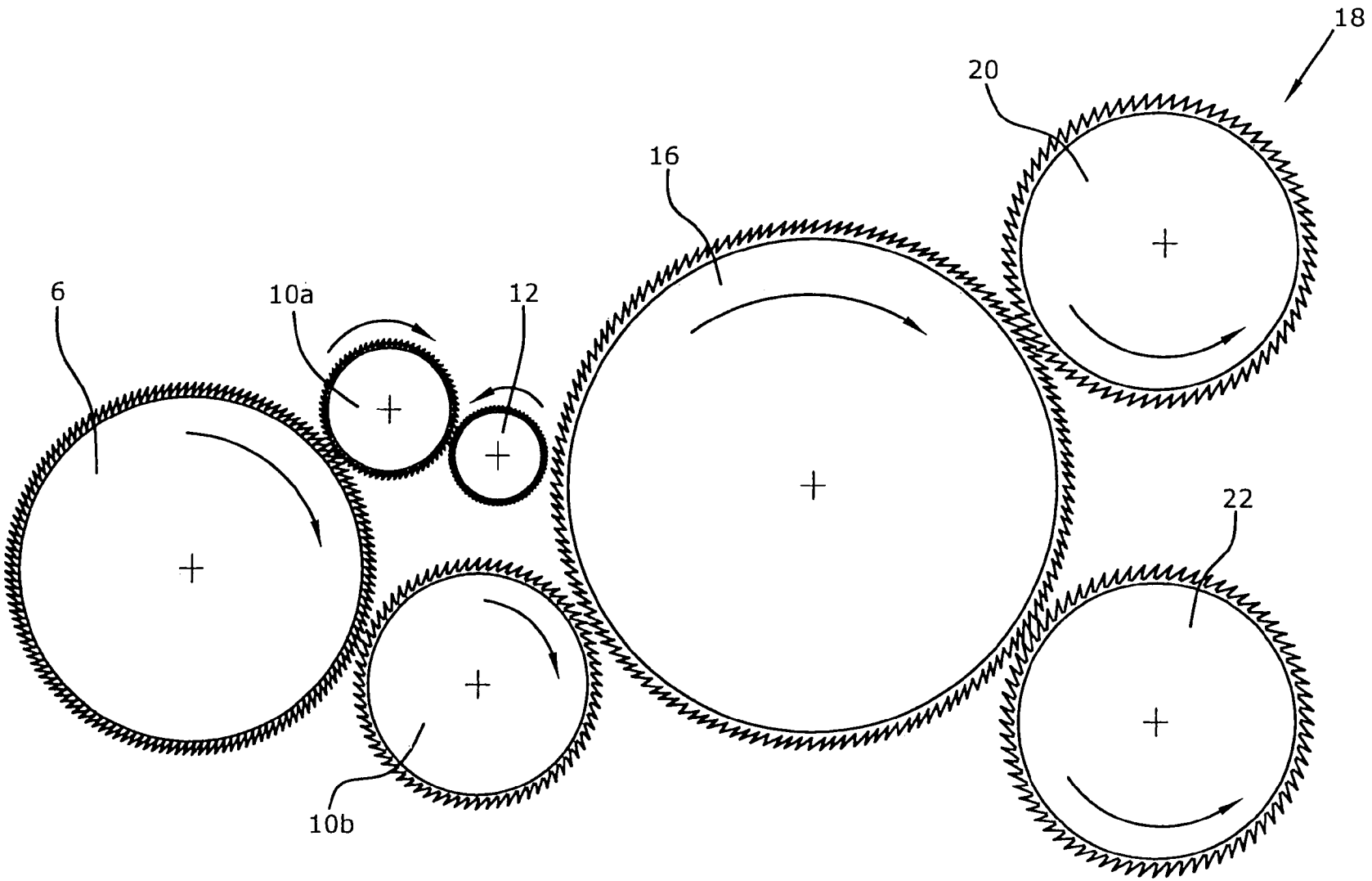
FIG. 6 shows a variant according to FIG. 5 with a second random roller.

FIG. 6 shows a variant of the embodiment according to FIG. 5 where the upper transfer path is formed by a random roller 10*a* engaged with the licker-in 6 and a transfer roller 12 engaged with the random roller 10*a* and the main cylinder 16.

Figure 7:
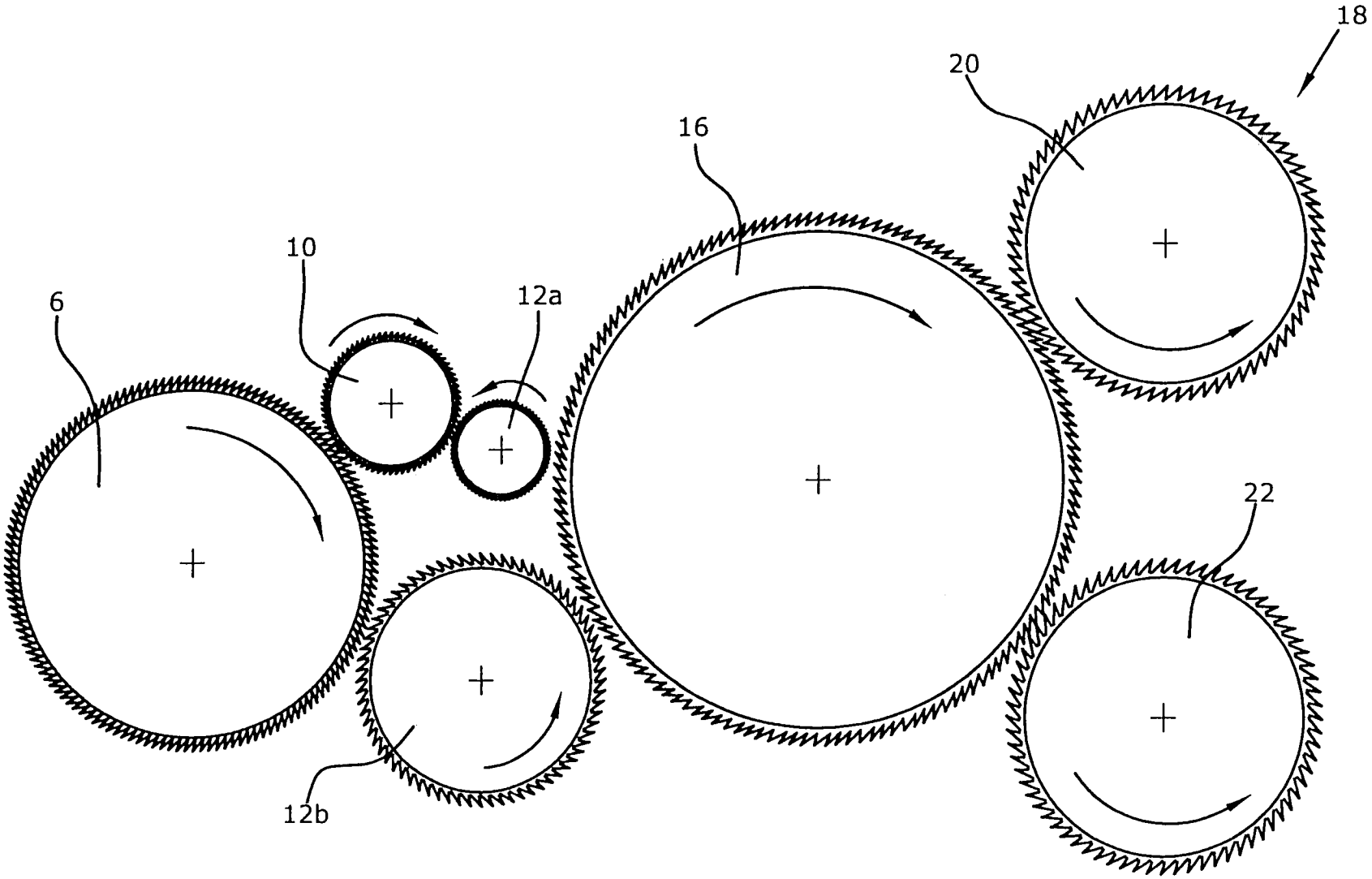
FIG. 7 shows a further variant of FIG. 5 with two transfer rollers and a random roller.

FIG. 7 shows an embodiment according to FIG. 6 where the lower transfer path is formed by a transfer roller 12*b*. The upper transfer path consists of a random roller 10 and a transfer roller 12*a*.

Figure 8:
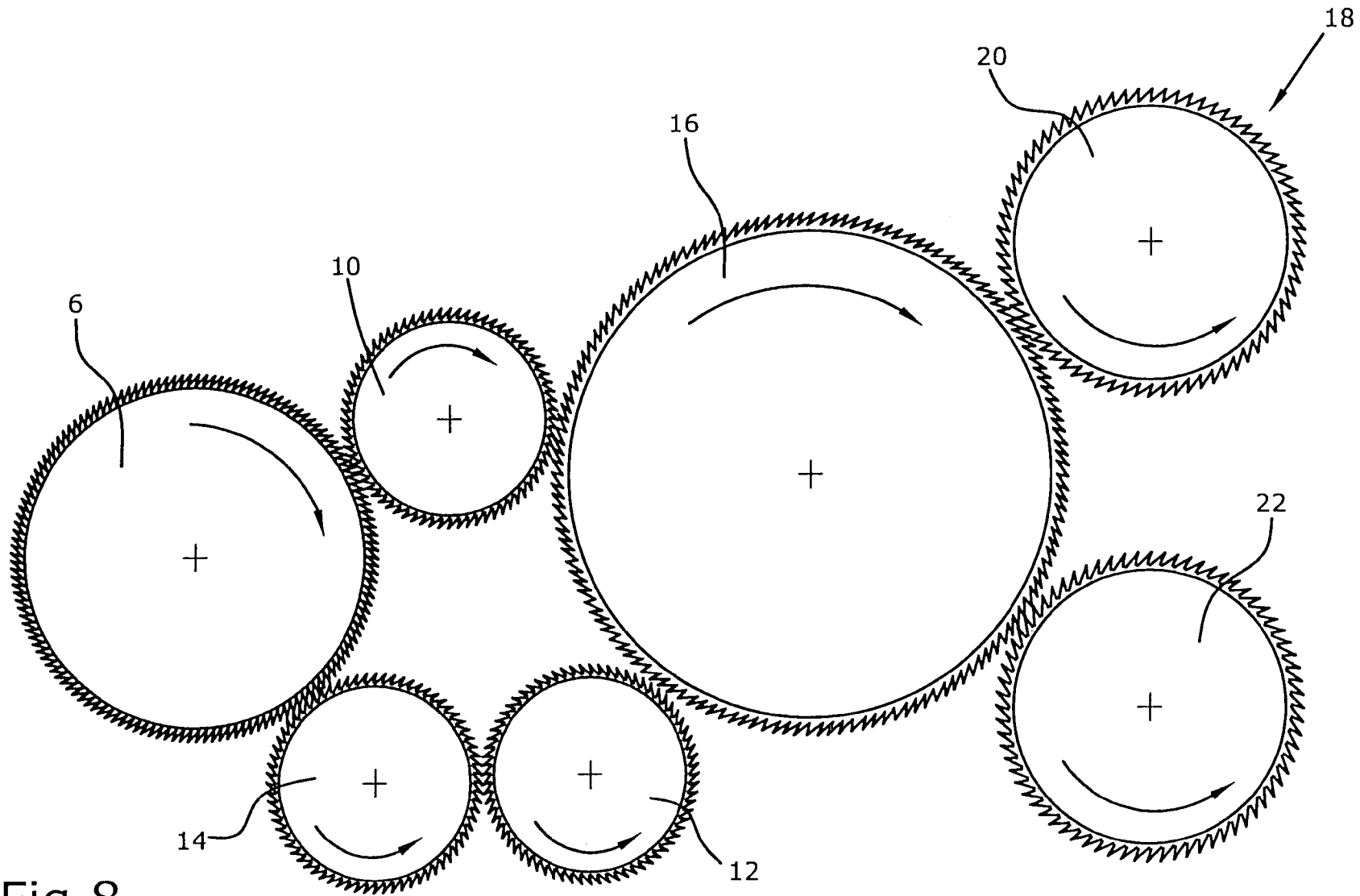
FIG. 8 shows an eighth embodiment with three transfer rollers in all.

FIG. 8 shows an embodiment where the upper transfer path is formed by a single random roller 10 and where the lower transfer path is formed by an intermediate doffer 14 and a transfer roller 12, the intermediate doffer being in engagement with the licker-in and the transfer roller 12 and the transfer roller 12 being in engagement with the main cylinder 16.

Figure 9:
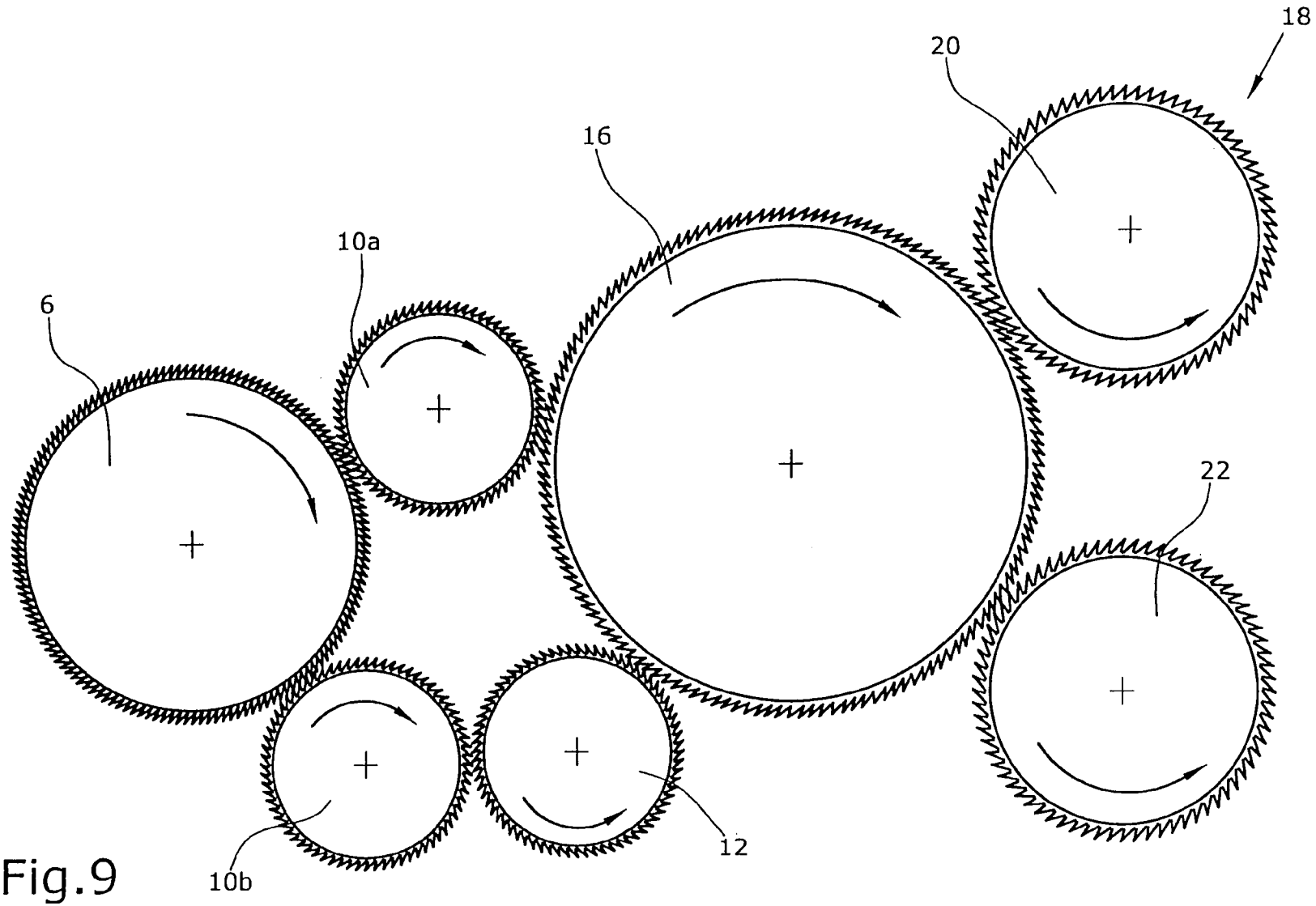
FIG. 9 shows a ninth embodiment.

FIG. 9 shows a variant of the embodiment of FIG. 8 where the upper transfer path is formed by a random roller 10*a* and the lower transfer path is provided with a second random roller 10*b* instead of the intermediate doffer 14.

Figure 10:
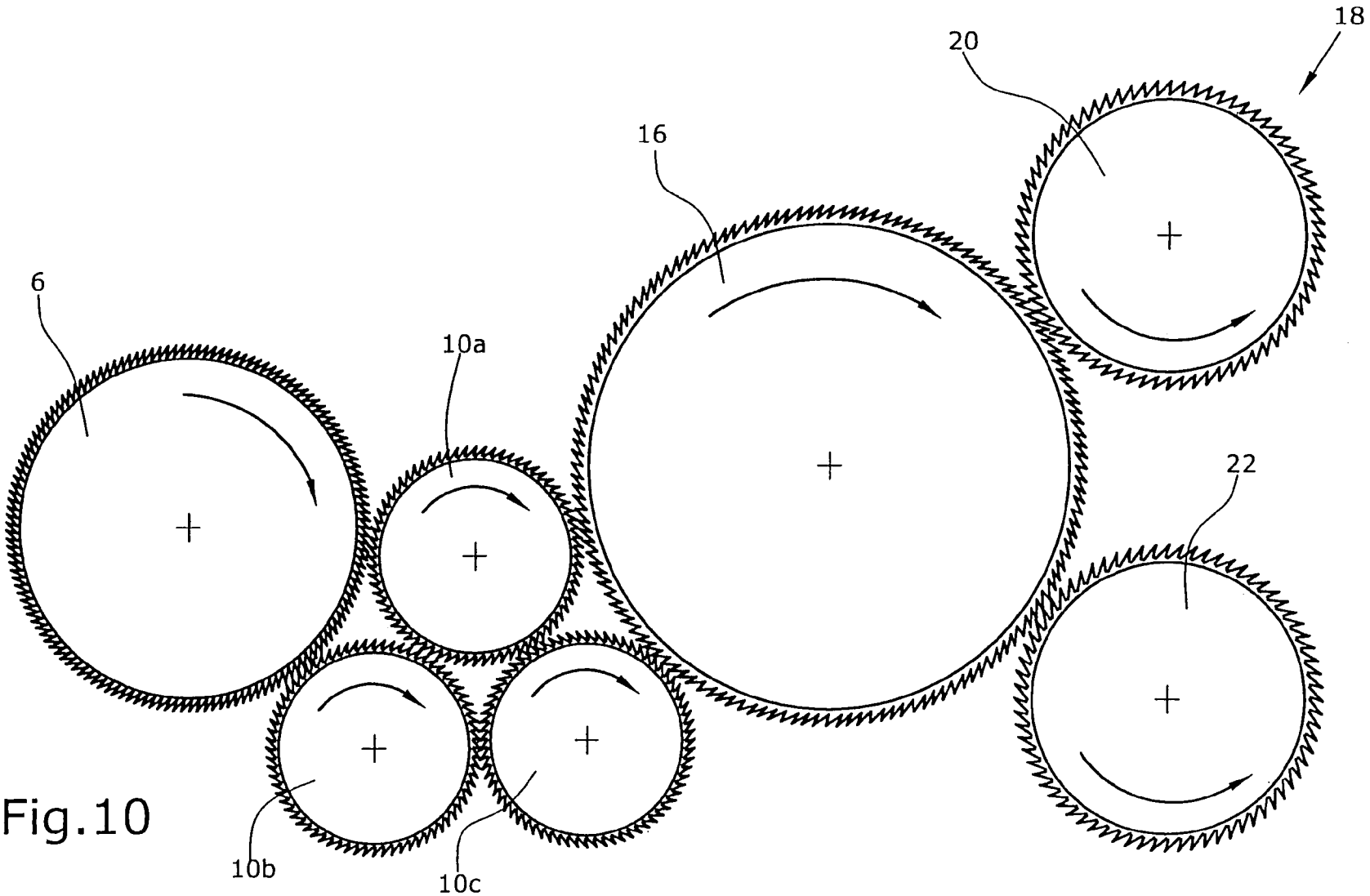
FIGS. 10–12 show embodiments with three transfer rollers in mutual engagement.

FIG. 10 shows an embodiment of the transfer means 8 formed by three random rollers 10*a*, 10*b* and 10*c* in mutual engagement, two random rollers 10*a* and 10*b* being engaged with the licker-in 6 and two random rollers 10*a*, 10*b* being engaged with the main cylinder 16, respectively.

Figure 11:
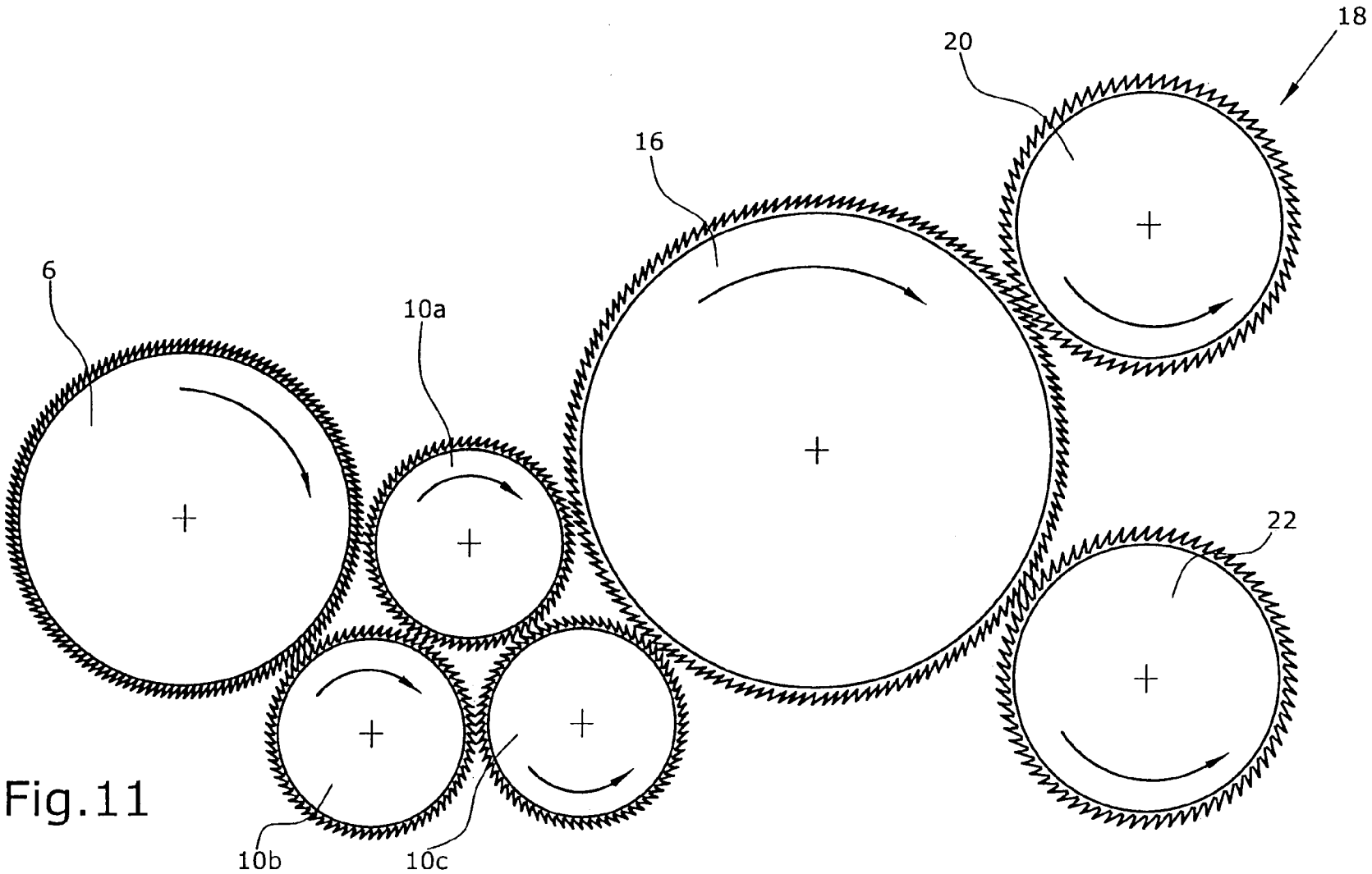

The embodiment of FIG. 11 differs from the embodiment of FIG. 10 in that one of the two rollers being in engagement with the main cylinder 16 is a transfer roller 12.

Figure 12:
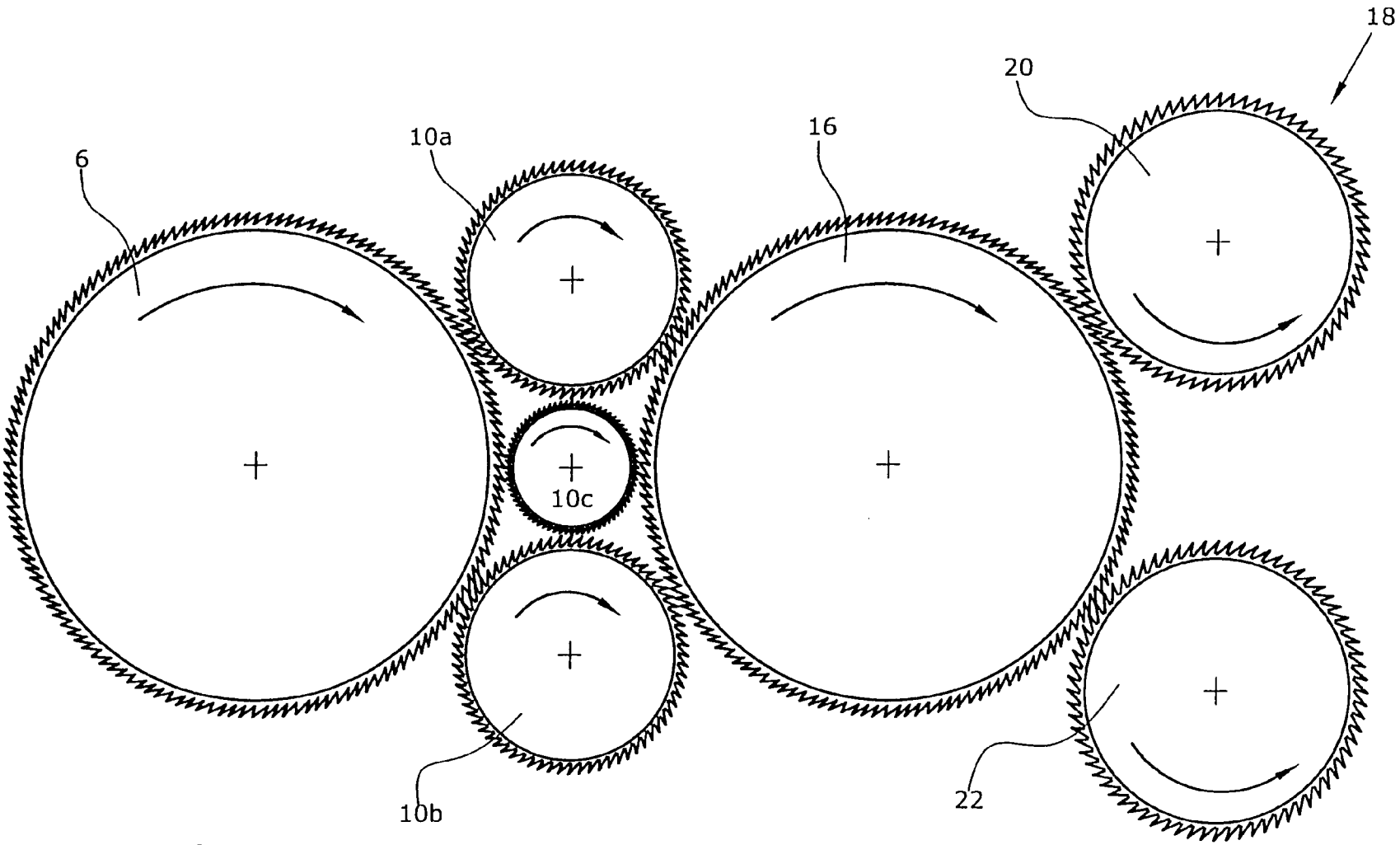

The embodiment of FIG. 12 shows a transfer means 8 formed of three random rollers 10*a*, 10*b*, 10*c* the axes of which are located on a single line. Compared with the upper and lower random rollers 10*a*, 10*b*, the central random roller 10*c* has a smaller diameter. The diameter of the central random roller 10*c* is selected such that the central random roller is engaged with the neighboring random rollers 10*a* and 10*b* as well as with the licker-in 6 and the main cylinder 16. By the high number of tangential contact surfaces between the random rollers 10*a*, 10*b*, 10*c* and the licker-in 6 and the main cylinder 16, an extremely high carding efficiency is ensured.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A nonwoven card for the production of nonwoven fabric of fiber material comprising a drawing-in means (2,4) in the form of rotating drawing-in (2) and taker-in (4) rollers, a licker-in roller (6) rotating oppositely to the rotation of said taker-in roller (4), a main cylinder (16), at least one fiber doffer means (18) engaged with the main cylinder (16) for doffing a fibrous web, the drawing-in means (2,4) transferring the fiber material to the licker-in roller (6) and transfer means (8) for transferring the fiber material from the licker-in roller (6) to the main cylinder (16) along two different transfer paths of travel via a plurality of transferring rollers (10, 10*a*, 10*b*, 10*c*, 12, 12*a*, 12*b*, 14), characterized in that at least one of the transferring rollers (10, 10*a*, 10*b*, 10*c*, 12, 12*a*, 12*b*, 14) of the transfer means (8) is a random roller (10, 10*a*, 10*b*, 10*c*) rotating in the same direction as the main cylinder (16) and the licker-in roller (6).

2. The nonwoven card according to claim 1, characterized in that the transfer means (8) has only a single roller (10, 10*a*, 10*b*, 10*c*, 12, 12*a*, 12*b*) between the licker-in roller (6) and the main cylinder (16) on at least one or each of the two different transfer paths.

3. The nonwoven card according to claim 2, characterized in that the only single roller is a random roller (10, 10*a*, 10*b*, 10*c*).

4. The nonwoven card according to claim 1, characterized in that a random roller (10, 10*a*, 10*b*, 10*c*) is arranged in combination with a transfer roller (12, 12*a*, 12*b*) on at least one of the two different transfer paths, and the random roller (10, 10*a*, 10*b*, 10*c*) is in engagement with the licker-in roller (6).

5. The nonwoven card according to claim 1, characterized in that the transfer means (8) comprises at least three transfer rollers (10, 10*a*, 10*b*, 10*c*, 12, 12*a*, 12*b*, 14) at least two of which are engaged with the licker-in roller (6) and the main cylinder (16), respectively.

6. The nonwoven card according to claim 5, characterized in that the at least three rollers (10, 10*a*, 10*b*, 10*c*, 12, 12*a*, 12*b*, 14) are in mutual engagement.

7. The nonwoven card according to claim 5, characterized in that the at least three rollers (10*a*, 10*b*, 10*c*) are respectively engaged at least with the licker-in roller (6) and the main cylinder (16).

8. The nonwoven card according to claim 7, characterized in that neighboring rollers (10*a*, 10*b*, 10*c*) of the transfer means (8) are in mutual engagement.

9. The nonwoven card according to claim 5, characterized in that all the rollers of the transfer means (8) are random rollers (10, 10*a*, 10*b*, 10*c*).

10. The nonwoven card according to claim 1, characterized in that the at least one random roller (10, 10*a*, 10*b*, 10*c*) comprises carding elements (24,26).

11. The nonwoven card according to claim 10, characterized in that the carding elements (24,26) include at least one pair of worker/clearer rollers (28,30) or of carding plates (24).

12. A method of producing nonwoven fabric of fiber material by means of a nonwoven card by supplying the fiber material via a rotating drawing-in roller (2) to an oppositely rotating taker-in roller (4) to a licker-in roller (6), by transferring the fiber material from the licker-in (6) to a main cylinder (16) for carding the fiber material, and by doffing at least one fibrous web from the main cylinder (16), characterized by the step of transferring the fiber material along two different transfer paths from the licker-in (6) to the main cylinder (16) by using at least one random roller (10, 10*a*, 10*b*, 10*c*) on at least one of the two different transfer paths.

* * * * *